US010419835B2

(12) United States Patent
Zhang et al.

(10) Patent No.: US 10,419,835 B2
(45) Date of Patent: Sep. 17, 2019

(54) ELECTRONIC DEVICE

(71) Applicant: Lenovo (Beijing) Co., Ltd., Beijing (CN)

(72) Inventors: Zhicheng Zhang, Beijing (CN); Honglei Zhu, Beijing (CN); Xiaozhong Li, Beijing (CN); Degui Zhang, Beijing (CN); Dianyong Yin, Beijing (CN)

(73) Assignee: LENOVO (BEIJING) CO., LTD., Beijing (CN)

( * ) Notice: Subject to any disclaimer, the term of this patent is extended or adjusted under 35 U.S.C. 154(b) by 0 days.

(21) Appl. No.: 15/812,022

(22) Filed: Nov. 14, 2017

(65) Prior Publication Data

US 2018/0192172 A1 Jul. 5, 2018

(30) Foreign Application Priority Data

Jan. 5, 2017 (CN) ..... 2017 1 0008172

(51) Int. Cl.

| | |
|---|---|
| ***H04R 1/02*** | (2006.01) |
| ***H04R 9/06*** | (2006.01) |
| *H04R 1/26* | (2006.01) |
| *H04R 1/28* | (2006.01) |

(52) U.S. Cl.

CPC ..... *H04R 1/02* (2013.01); *H04R 9/06* (2013.01); *H04R 1/26* (2013.01); *H04R 1/2811* (2013.01)

(58) Field of Classification Search

CPC ..... H04R 1/02; H04R 1/26; H04R 1/2811; H04R 9/06

See application file for complete search history.

(56) References Cited

U.S. PATENT DOCUMENTS 6,956,956 B2 * 10/2005 Kuratani ..... H04R 1/02 381/345
7,349,207 B2 * 3/2008 Harris ..... H04R 9/022 361/690
7,388,963 B2 * 6/2008 Han ..... H04R 1/2819 381/165

FOREIGN PATENT DOCUMENTS

| | | | |
|---|---|---|---|
| CN | 201039342 | Y | 3/2008 |
| CN | 101685324 | A | 3/2010 |
| CN | 201657235 | U | 11/2010 |
| CN | 103200490 | A | 7/2013 |
| CN | 106162391 | A | 11/2016 |

* cited by examiner

*Primary Examiner* — Brian Ensey

(74) *Attorney, Agent, or Firm* — Anova Law Group, PLLC

(57) ABSTRACT

An electronic device includes a first speaker for generating a first sound wave; a first chamber coupled to a first side of the first speaker for outputting the first sound wave generated by the first speaker; a second chamber coupled to a second side of the first speaker; a functional device in the second chamber including at least one functional device that generates heat during operation; and a hollow duct located in the second chamber for transporting air from the second chamber to an outlet of the hollow duct, dissipating heat generated by the functional device.

18 Claims, 7 Drawing Sheets

ELECTRONIC DEVICE

CROSS-REFERENCES TO RELATED APPLICATIONS

This application claims priority to Chinese Patent Application No. 201710008172.7, filed on Jan. 5, 2017, the entire content of which is incorporated herein by reference.

TECHNICAL FIELD

The present disclosure relates to the field of electroacoustic equipment technology and, more particularly, to an electronic device.

BACKGROUND

Electronic devices such as intelligent audio, multimedia audio, etc., have become commonly used audio equipment in daily life. With the improvement of living quality, user requirements on the audio effects, outlook appearance, and other aspects of the audio equipment are becoming higher.

To achieve a better design of the audio equipment, it is important to improve the cooling method of electronic components of the device.

BRIEF SUMMARY

In accordance with some embodiments of the present disclosure, an information processing method, and a related storage device are provided.

One aspect of present disclosure provides an electronic device. The electronic device includes a first speaker for generating a first sound wave; a first chamber coupled to a first side of the first speaker for outputting the first sound wave generated by the first speaker; a second chamber coupled to a second side of the first speaker; a functional device in the second chamber including at least one functional device that generates heat during operation; and a hollow duct located in the second chamber for transporting air from the second chamber to an outlet of the hollow duct, dissipating heat generated by the functional device.

In some embodiments, the first sound wave generated by the first speaker drives air from the second chamber into the hollow duct. The air discharged from the outlet of the hollow duct passes by the functional device to dissipate heat from the functional device. The first chamber is a front sound chamber of the first speaker; and the second chamber is a rear sound chamber of the first speaker. The hollow duct is an inverting tube that changes a phase of the first sound wave generated by the first speaker.

In some embodiments, the hollow duct changes the phase of the first sound wave in the second chamber to a same phase of the first sound wave in the first chamber to enhance an audio effect of the first speaker. The outlet and an intake of the hollow duct are bent. Each of the intake and the outlet of the hollow duct is a divergent opening. The intake of the hollow duct is obliquely extended with respect to a top wall of the second chamber. A volume of the second chamber is larger than a volume of the first chamber.

In some embodiments, the first sound wave having a frequency not higher than a first frequency threshold; a second speaker for generating a second sound wave having a second frequency not higher than a second frequency threshold; and the second frequency threshold is higher than the first frequency threshold.

In some embodiments, a housing enclosing the second chamber and the functional device. The first speaker and the second speaker have a same orientation; the first speaker is located at the top of the second speaker; the second chamber is located at the top of the first speaker; an input device is located at the top of the second chamber; and the first chamber is located between the first speaker and the second speaker.

In some embodiments, a casing having a plurality of ventilation holes for enclosing the first chamber and the second speaker; and an outer surface of the casing is covered with a dust barrier.

Another aspect of the present disclosure provides an electronic device. The electronic device includes a first speaker for generating a first sound wave; a first chamber coupled to a first side of the first speaker for outputting the first sound wave generated by the first speaker; a second chamber coupled to a second side of the first speaker; a functional device including at least one functional device that generates heat during operation; a third chamber, the functional device being located in the third chamber; a hollow duct located in the second chamber for transporting air from the second chamber to an outlet of the hollow duct, dissipating heat generated by the functional device.

In some embodiments, the third chamber includes an opening; and the air discharged from an outlet the hollow duct passes through the opening. The air in the third chamber dissipates the heat of the functional device by convection through the opening. The outlet of the hollow duct is obliquely extended with respect to a side wall of the second chamber towards a position of the opening of the third chamber.

In some embodiments, the third chamber includes a first opening and a second opening, the air discharged from the outlet of the hollow duct enters the third chamber through the first opening; and the air flows out of the third chamber through the second opening, passing by the functional device.

Other aspects of the present disclosure can be understood by those skilled in the art in light of the description, the claims, and the drawings of the present disclosure.

BRIEF DESCRIPTION OF THE DRAWINGS

Various objectives, features, and advantages of the present disclosure can be more fully appreciated with reference to the detailed description of the present disclosure when considered in connection with the following drawings, in which like reference numerals identify the same or like elements unless otherwise specified. That the following drawings are merely examples for illustrative purposes according to various disclosed embodiments and are not intended to limit the scope of the present disclosure.

DETAILED DESCRIPTION

Exemplary embodiments of the disclosure will be described in detail with reference to the accompanying drawings. The following description is made only by way of example, but does not limit the present disclosure. Various embodiments of the present disclosure and various features in the embodiments that do not conflict with each other can be combined and rearranged in various ways. Without departing from the spirit and scope of the present disclosure, modifications, equivalents, or improvements to the present disclosure are conceivable to those skilled in the art and are intended to be encompassed within the scope of the present disclosure.

In accordance with various embodiments, the present disclosure provides an electronic device including an improved structure that can increase the heat dissipation to the functional devices of the electronic device without affecting the external appearance or enlarging the noise of the electronic device.

The operations of the audio systems may be controlled by a functional device assembly. In some embodiments, the functional device assembly is a printed circuit board (PCB) including micro-control units (MCUs). The operating functional device assembly and the functional devices (e.g., micro-control units) are all heat generating devices. The generated heat may have a certain effect on the normal operation of the audio system, especially on the power amplifier of the audio system which has a power of tens or hundreds of watts. That is, the heat dissipation problem has a non-negligible impact on the operation of the audio systems. However, adding a large number of heat emission holes to a speaker may affect the appearance of audio system. Adding internal fans may increase the noise, thereby affecting the sound effect of the audio system.

Figure 1:
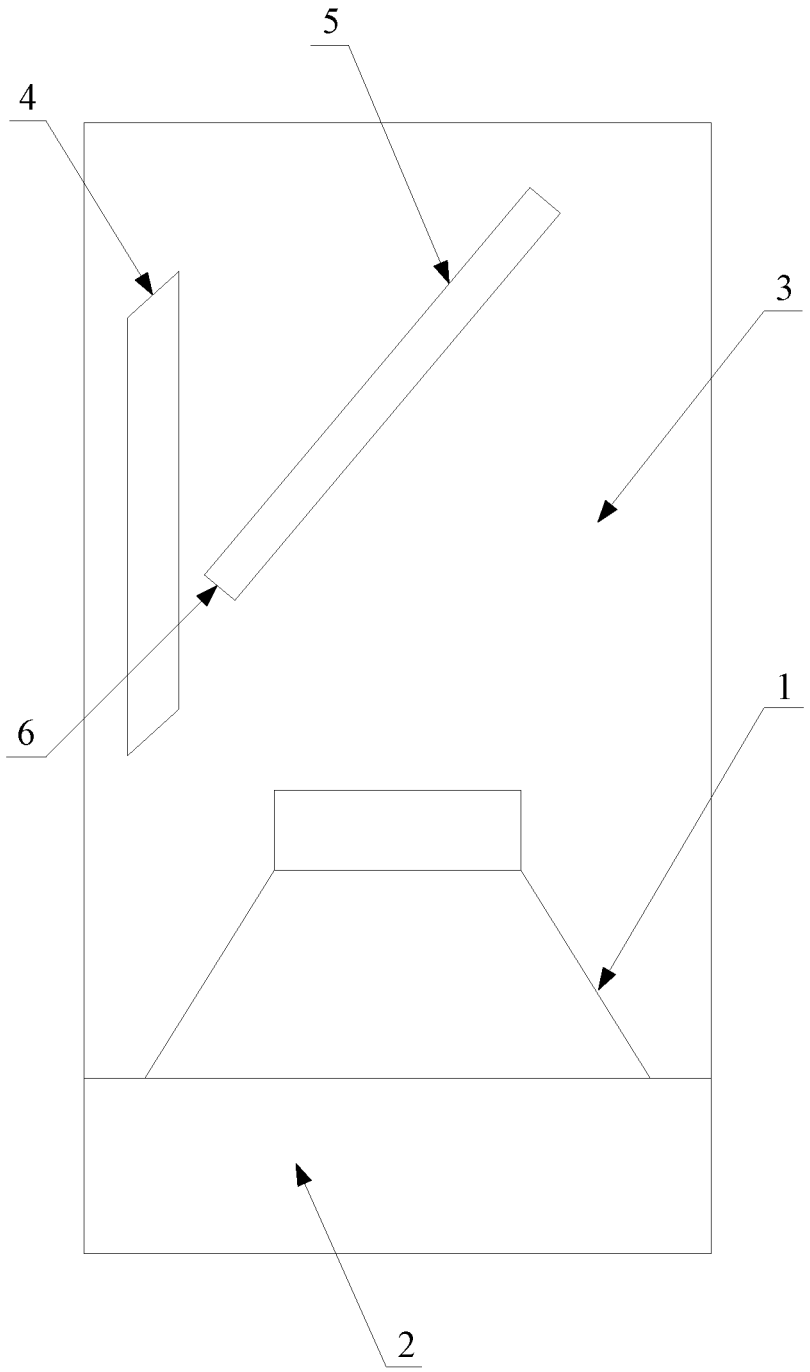
FIG. 1 illustrates a schematic structural diagram of an exemplary electronic device including a first speaker, a first chamber, a second chamber, a functional device assembly, and a hollow duct in accordance with some embodiments of the present disclosure.
Figure 2:
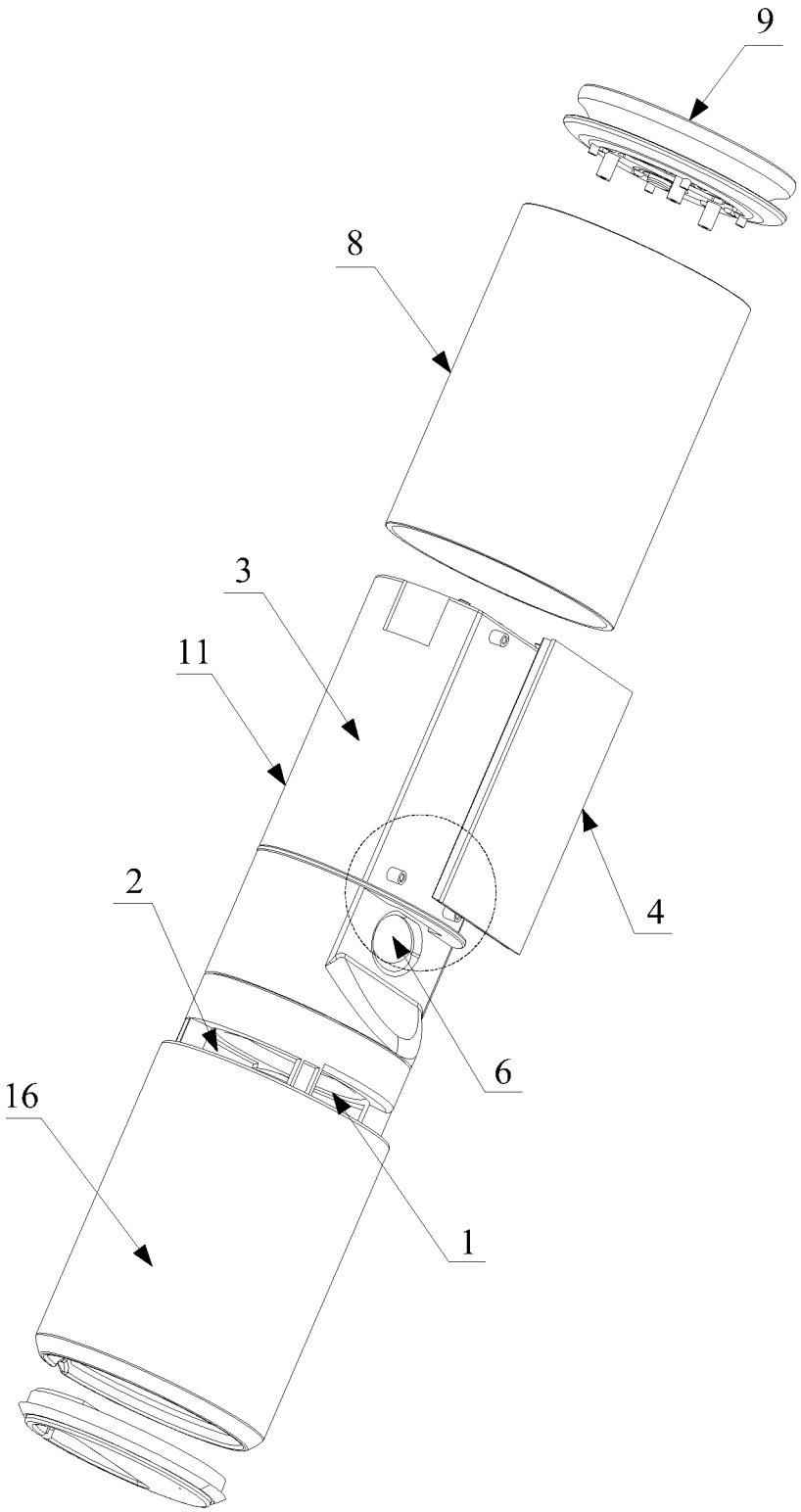
FIG. 2 illustrates a schematic diagram of a exploded view of an exemplary electronic device in accordance with some embodiments of the present disclosure.
Figure 3:
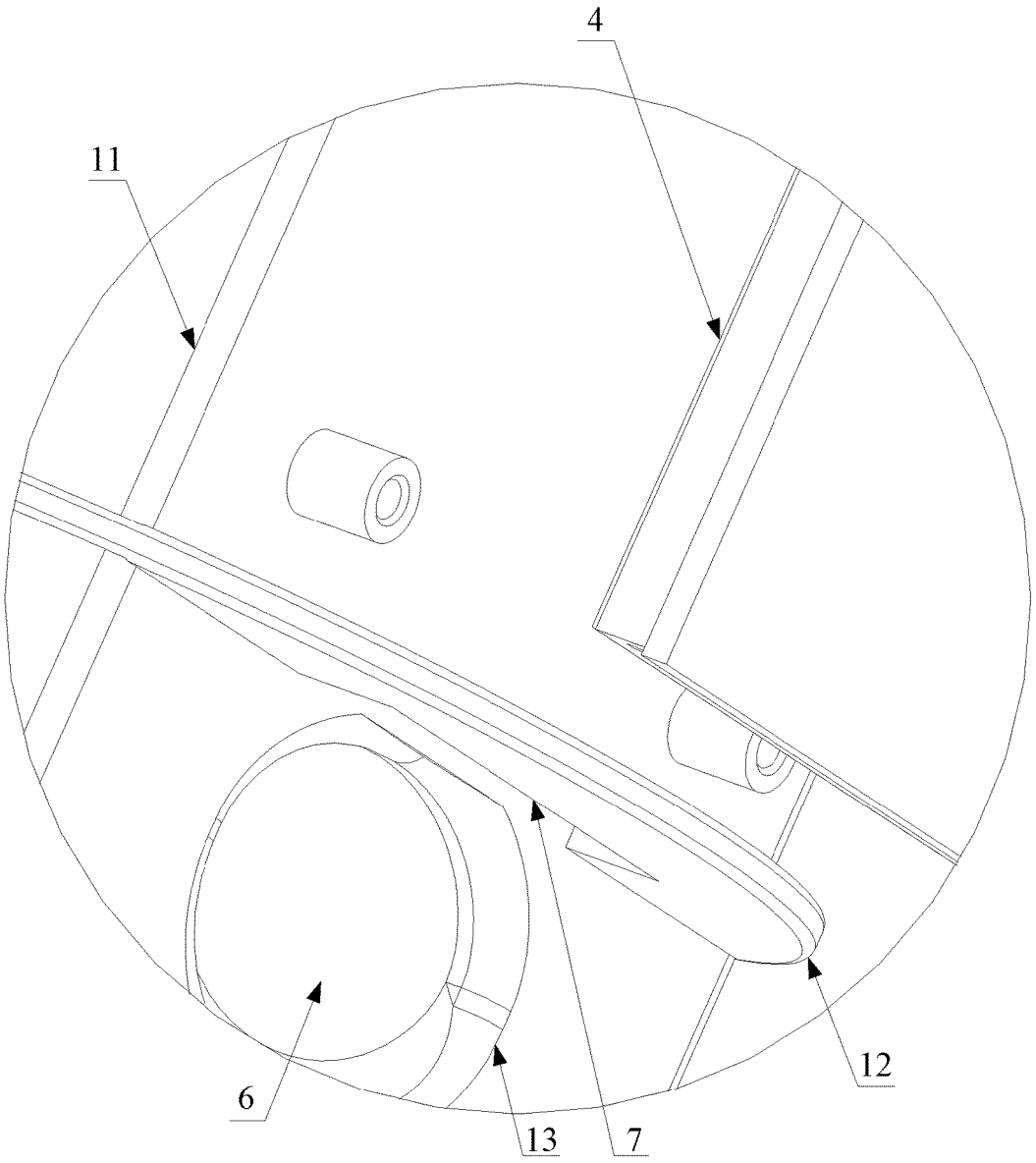
FIG. 3 illustrates a schematic diagram of a partial enlarged view of the electronic device shown in FIG. 1 in accordance with some other embodiments of the present disclosure.
Figure 4:
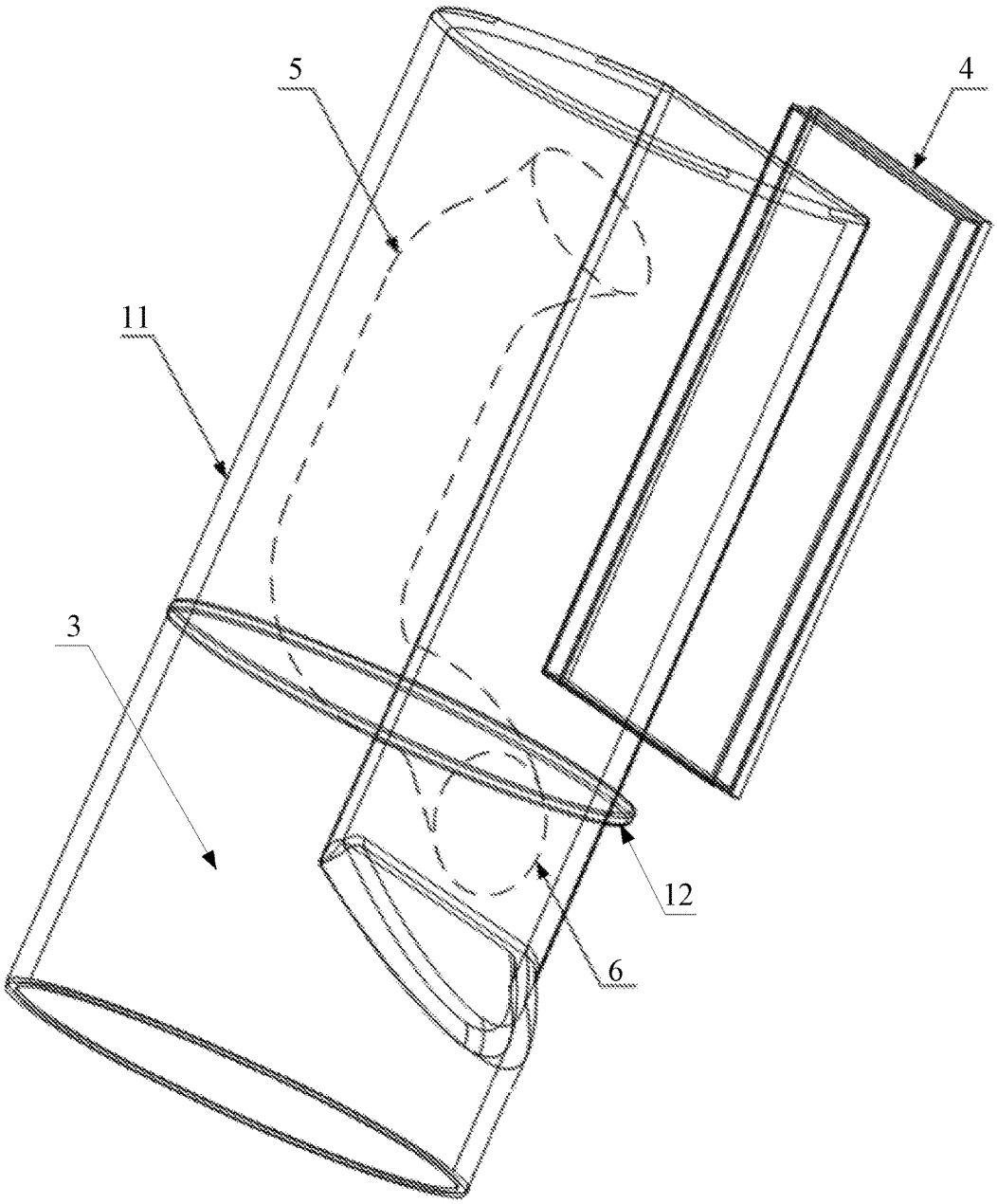
FIG. 4 illustrates a schematic structural diagram of an exemplary combination of a hollow duct, a wall of a second chamber, and a functional device assembly in accordance with some embodiments of the present disclosure.
Figure 5:
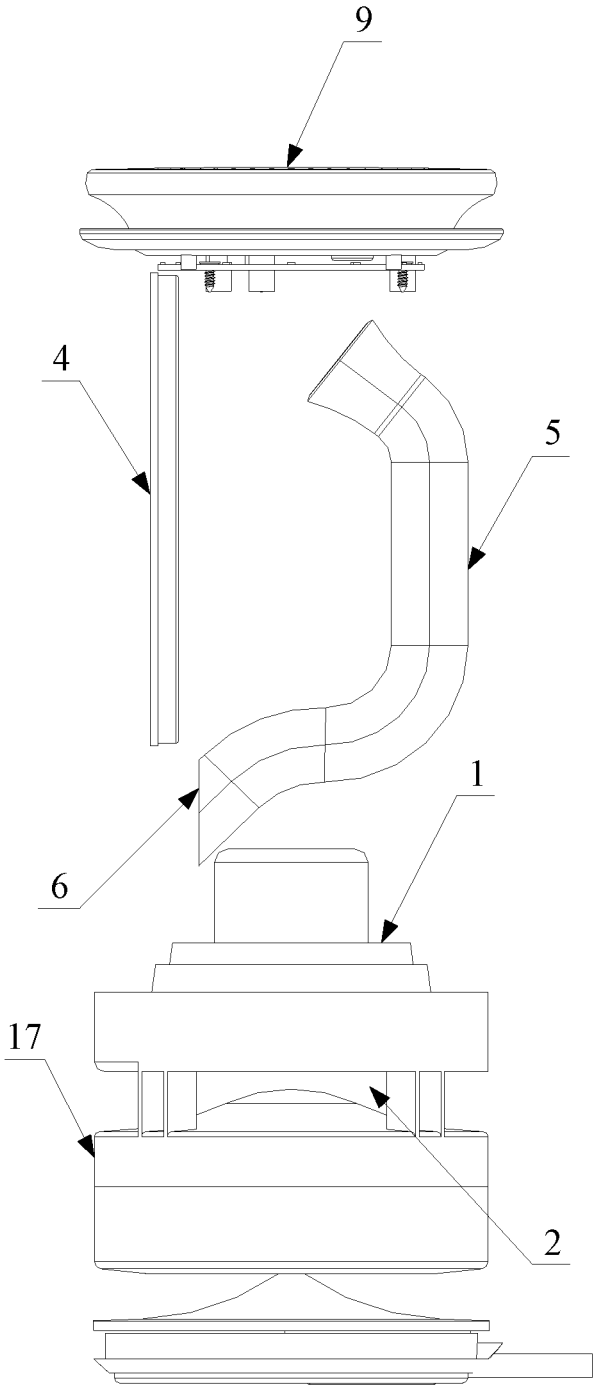
FIG. 5 illustrates a schematic structural diagram of an exemplary combination of an input device, a functional device assembly, a hollow duct, a first speaker, a first chamber and a second speaker in accordance with some other embodiments of the present disclosure.
Figure 6:
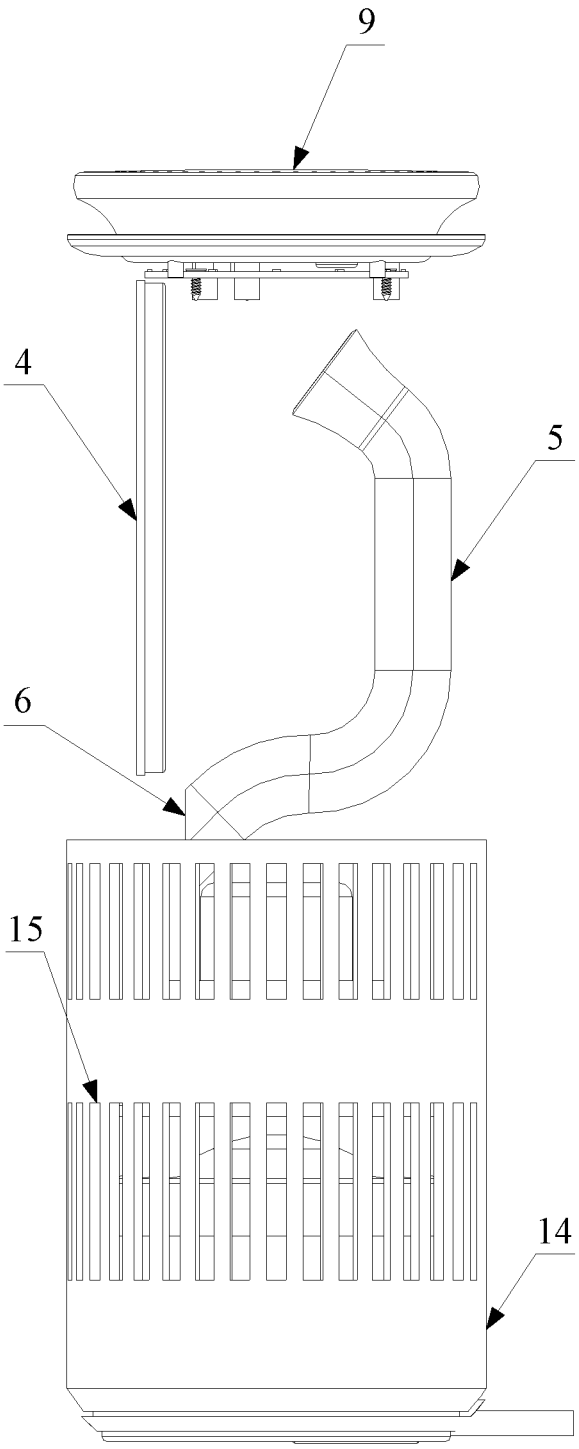
FIG. 6 illustrates a schematic structural diagram of an exemplary combination of the components shown in FIG. 5 and a housing in accordance with some embodiments of the present disclosure.
Figure 7:
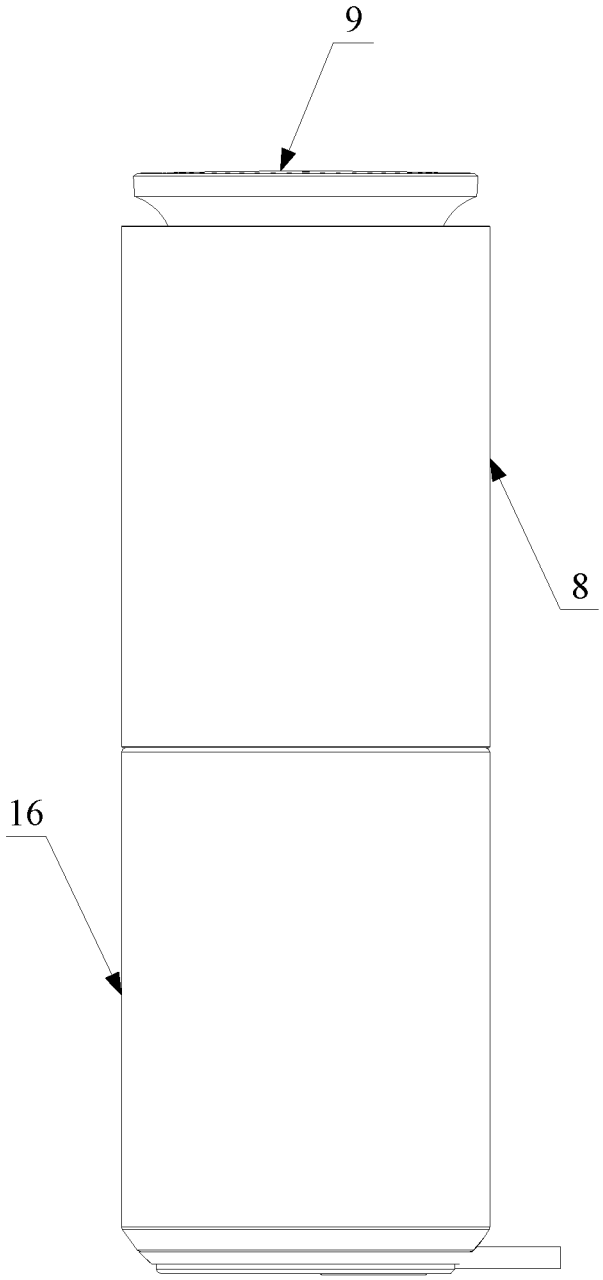
FIG. 7 illustrates a schematic diagram of an exemplary external view of an electronic device in accordance with some other embodiments of the present disclosure.

Referring to FIGS. 1-7, FIG. 1 illustrates a schematic structural diagram of an exemplary electronic device in accordance with some embodiments of the present disclosure. FIG. 2 illustrates a schematic diagram of an exploded view of the electronic device. FIG. 3 illustrates a schematic diagram of a partial enlarged view of the electronic device. FIG. 4 illustrates a schematic structural diagram of an exemplary combination of a hollow duct, a wall of a second chamber, and a functional device assembly. FIG. 5 illustrates a schematic structural diagram of an exemplary combination of an input device, a functional device assembly, a hollow duct, a first speaker, a first chamber and a second speaker. FIG. 6 illustrates a schematic structural diagram of an exemplary combination of the components shown in FIG. 5 and a housing. FIG. 7 illustrates a schematic diagram of an exemplary external view of an electronic device.

As shown in FIGS. 1 and 4, the electronic device can include a first speaker 1, a first chamber 2, a second chamber 3, a functional device assembly 4, and a hollow duct 5.

The first speaker can be used for generating a sound not higher than a first frequency. For example, the first frequency can be 150 Hz, 500 Hz, 5000 Hz, etc.

The first chamber 2 can be located on one side of the first speaker 1 for outputting the sound generated by the vibration of the first speaker 1. That is, the first chamber 2 can be a front sound chamber of the first speaker 1.

The second chamber 3 can be located on another side of the first speaker 1. That is, the second chamber 3 can be a rear sound chamber of the first speaker 1.

The functional device assembly 4 can be used for controlling the operation of the electronic device. In some embodiments, the functional device assembly 4 can be a printed circuit board. The functional device assembly 4 includes at least one functional device that is capable of generating heat during the operation of the functional device assembly 4. The at least one functional device can be a micro-control unit on the printed circuit board.

The hollow duct 5 can be used for dissipating the heat generated by the functional device assembly 4 of the electronic device. In some embodiments, the hollow duct 5 can be located in the second chamber 3.

Because the second chamber 3 is the rear sound chamber of the first speaker 1, the air in the second chamber 3 can be pressed and pushed back and forth during the vibration of the first speaker 1. As such, the air can be driven into the hollow duct 5 from the second chamber 3. The air entering the hollow duct 5 can flow through the hollow duct 5 and then be discharged from an outlet end 6 of the hollow duct 5. The air flow of the discharged air can dissipate the heat generated by the functional device assembly 4.

During the operations of the electronic device, the first speaker 1 can vibrate back and forth to produce sound, and can squeeze the air in the first chamber 2 and the second chamber 3. Since the first chamber 2 is connected with the air outside the electronic device, the first speaker 1 can drive the air in the first chamber 2 to vibrate to form sound waves that can propagate to the outside of the electronic device.

During the vibrations of the first speaker 1, the air in the first chamber 2 can pass through the first speaker 1 and enter into the second chamber 3 which is located at another side of the first speaker 1. The air entering the second chamber 3 can be driven by the vibration of the first speaker 1 to move into the hollow duct 5. The air in the hollow duct 5 can be discharged from the outlet end 6 and flow to the outside of the electronic device.

When the air is discharged from the outlet end 6, the air flows through the location of the functional device assembly, and/or can drive the airflow at the vicinity of the functional device assembly, thereby dissipating the heat generated by the functional device assembly.

In the above-described process, the air can pass through the first speaker 1 by using any suitable method. For example, the air can pass through a diaphragm of the first speaker 1. As another example, the air can pass through a ventilation structure around the first speaker 1, such as a one-way air tube structure between the first chamber 2 and the second chamber 3. As yet another example, a ventilation area of the structure between the first chamber 2 and the second chamber 3 is smaller than an opening area of the outlet end 6 of the hollow duct 5 that can discharge air to the outside of the second chamber 3.

In some embodiments, the electronic device can realize heat dissipation of the functional device assembly without requiring additional heat emission holes or internal fans. By using the vibration from the operation of first speaker 1, the air can be driven to flow and be guided by the hollow duct 5. As such, when the first speaker 1 is operating, the heat dissipation of the functional assembly can be performed at the same time. In embodiments of the present disclosure, without affecting the external appearance or increasing the noise of the electronic device, the heat dissipation of the functional device assembly can be achieved, such that the cooling of the electronic device can be optimized. In addition, the above described heat dissipating method of using the hollow duct 5 can reduce the cost, improve the sound quality, and increase the utilization efficiency of the internal space of the electronic device.

In some embodiments, as shown in FIGS. 2-4, the electronic device can further include a third chamber having one or more openings 7. The functional device assembly 4 can be disposed within the third chamber. The air discharged from the outlet end 6 can pass through the one or more openings 7.

By using the third chamber, the arrangement of the various components of the electronic device can be more uniform and reasonable, such that the interference between the various components can be reduced. In this embodiment, since the functional device assembly 4 is separately located in the third chamber, the functional device assembly 4 can be isolated from the air in the second chamber 3. Thus, by preventing the functional device assembly 4 from affecting the flow of air in the second chamber 3, a desirable audio performance of the electronic device may be ensured.

In order to ensure the heat dissipation of the functional devices on the functional device assembly 4, the one or more openings 7 can be provided on the third chamber to interconnect the inner chamber of the third chamber and the outlet end 6 of the hollow duct 5. As such, the air discharged from the outlet end 6 can flow through the positions of the functional devices, or can drive the airflow at the vicinity of the functional devices to dissipate heat.

In some embodiments, the third chamber has one or more openings 7. The outlet end 6 of the hollow duct 5 can interconnected to the outside through the one or more openings 7. Since the functional device assembly is located in the third chamber, and/or the heat generated by the functional device assembly is more than the heat generated by the first speaker 1, the temperature of the air discharged from the outlet end 6 of the hollow duct 5 is lower than the temperature of the air in the third chamber. As such, the air in the third chamber can be cooled through the one or more openings 7, and the heat dissipation of the functional devices can be achieved by convection, as shown in FIG. 3.

In some embodiments, the heat dissipation structure is that the third chamber has a single opening 7 located near the outlet end 6 of the hollow duct. Excepting the opening 7, all other portions of the third chamber are closed.

The functional device assembly 4 located in the third chamber can generate heat during the operation, thus the temperature of the air in the third chamber is higher than the temperature of the air in the other parts of the electronic device. When the air in the hollow duct 5 which has a lower temperature is discharged from the outlet end 6, the air can flow through the opening 7.

Due to the temperature difference between the air having a higher temperature in the third chamber near the opening 7 and the air discharged from the outlet end 6, the air having a higher temperature in the third chamber can be subjected to convection through the opening 7. As such, the heat in the third chamber can be brought out to realize the heat dissipation of the functional device assembly.

In addition to satisfy the heat dissipation requirement, the above described heat dissipation structure can improve the protective effect on the functional device assembly 4. Further, the above described heat dissipation structure is simple and easy to be produced.

In some alternative embodiments, the one or more openings 7 can include a first opening and a second opening (not shown in the figures). The air discharged from the outlet end 6 can pass through the first opening to enter the third chamber. After flowing through the functional device assembly 4, the air can pass through the second opening to go to the outside. As such, the heat dissipation of the functional device assembly can be realized.

It should be noted that, the two openings can be located on any suitable positions on the third chamber. For example, the first opening can be located on the bottom wall of the third chamber, and the second opening can be located on the top wall of the third chamber. The locations of the first opening and the second opening can be aligned to each other. As such, the air convection effect can be maximized to enhance the heat dissipation effect of the functional device assembly.

In some alternative embodiments, the functional device assembly 4 can be located in the second camber 3, which is the rear sound chamber of the first speaker 1. The air discharged from the outlet end 6 can pass through at least one functional device on the functional device assembly 4. The hollow duct 5 can be located in the second chamber 3, while the outlet end 6 of the hollow duct 5 can be located directly towards the function device assembly 4, or close to the function device assembly 4. As such, the air discharged from the outlet end 6 can blow the functional device assembly to dissipate the heat generated by the functional device assembly.

When the functional device set 4 is located in the second chamber 3, the outlet end 6 of the hollow duct 5 can be located in any suitable position of the second chamber 3, and can be interconnected to the outside of the electronic device through an air passage (not shown in the figures).

It should be noted that, the functional device assembly 4 can be arranged in any suitable way in the second chamber 3. For example, the functional device assembly 4 can be arranged parallel to a side wall of the second camber 3 and being attached to the side wall, such that the second chamber 3 can have an enough space for air flowing, thereby ensuring a desirable audio effect of the electronic device. As another example, the functional device assembly 4 can be arranged perpendicular to a side wall of the second chamber 3, such that air in the second chamber 3 can pass through the functional device assembly 4 on both sides, thereby enhancing the heat dissipation effect.

As shown in FIGS. 4-6, in some embodiments, the hollow duct 5 in the second chamber 3 can be an inverting tube that can change the phase of the sound waves in the second chamber 3 generated by the first speaker 1. The phase of the sound waves in the second chamber 3 can be changed to the same phase or similar to the phase of the sound waves in the first chamber 2 generated by the first speaker 1, such that the audio effect of the first speaker 1 can be enhanced.

That is, the hollow duct 5 is not only a heat dissipating component for the functional device assembly, but also serves as an inverting tube for enhancing the audio effect. By performing multiple functions simultaneously, the hollow duct can maximize the performance of the electronic device.

As shown in FIGS. 4-6, both ends of the hollow duct 5 can be elbow bent in some embodiments. The outlet end 6 of the hollow duct 5 can extend obliquely with respect to the side wall of the second chamber 3, and can extend to the position of the opening 7 of the third chamber. As such, the outlet end 6 and the opening 7 can be close to each other, thereby improving the heat dissipation effect.

The other end of the hollow duct 5, i.e., the intake end, can extend obliquely with respect to the top wall of the second chamber, such that the intake end is not disposed orthogonally with respect to the top was of the second chamber, or disposed orthogonally with respect to the first speaker 1. As such, the air cannot enter into the intake end directly along a straight path, thereby generating a larger pressure of the second chamber 3 to enhance the audio effect of the electronic device.

Further, the intake end and the outlet end 6 of the hollow duct 5 can be divergent ports that can improve the flowability of the air, thereby enhancing the heat dissipation effect to the functional device assembly.

In some embodiments, the volume of the second chamber 3 can be larger than the volume of the first chamber 2. The electronic device can be any suitable electronic device that includes an audio system, such as a playback device, a television, a computer, a projector, etc. In order to further enhance the audio performance of the first speaker 1, the second chamber 3, which serves as a rear sound chamber, can have a larger volume comparing to the first chamber 2 which serves as a front chamber.

As illustrated in FIG. 5, the electronic device can further include a second speaker 17 for generating a sound that has a frequency not higher than a second frequency. In some embodiments, the value of the second frequency can be larger than the value of the first frequency. For example, the second frequency may be 500 Hz, 5000 Hz, or 20000 Hz.

It should be noted that, each of the first speaker 1 and the second speaker 17 can be a woofer, a midrange speaker, or a tweeter. The first speaker 1 and the second speaker 17 can operate as any suitable combination, such as bass/midrange, bass/treble, midrange/treble, etc.

In some embodiments, the first speaker 1 can be a woofer, and the first frequency can be the highest limit of the bass, e.g., a specific value of 150 Hz. The second speaker 17 can be a tweeter, and the second frequency can be the highest limit of the treble, e.g., a specific value of 20000 Hz. In some embodiments, the value of the first frequency can be within a bass frequency range, e.g., from 30 Hz to 150 Hz. The value of the second frequency can be within a treble frequency range, e.g., from 5000 Hz to 20000 Hz. That is, the upper limit of the first frequency can be less than the lower limit of the second frequency. By using the two speakers to generate treble and bass respectively, the audio effect of the electronic device can be significantly enhanced.

In some embodiments, the electronic device can include a housing 8, and chamber walls that form the second chamber 11. The functional device assembly 4 and the chamber walls of the second chamber 11 can be enclosed within the housing 8. The housing 8 can protect the second chamber 3. The chamber walls can form the second chamber 11 as a separate chamber that is isolated from the other chambers. As such, the sealing performance of the second chamber 3 can be ensured, and the arrangement of the third chamber can be flexible.

In some embodiments, as shown in FIGS. 1 and 7, the electronic device can have a columnar structure. The first speaker 1 can be located at the middle of the columnar structure, and the second speaker 17 can be located at the bottom of the first speaker 1, as shown in FIG. 5. The second chamber 3 can be located at the top of the first speaker 1 and serve as a rear chamber of the first speaker 1, In some embodiments, an input device 9 can be located at the top of the second chamber 3, that is, at the top of the electronic device. The input device 9 can include any suitable input devices, such as a touch screen, a knob or a keyboard, etc. The input device 9 can be electrically connected to the functional device assembly 4. The arrangement of the input device 9 at the top of the electronic device can enable the user to operate the electronic device more conveniently.

As shown in FIG. 5, the first chamber 2 serving as front sound chamber of the first speaker 1 can be located between the first speaker 1 and the second speaker 17. The orientation of the second speaker 17 and the first speaker 1 can be the same. That is, both of the front sound chambers of the first speaker 1 and the second speakers 17 can be located at the bottom of the first speaker 1 and the second speakers 17 respectively. As such, the first speaker 1 and the second speaker 17 can be played through the front chambers located in the different positions.

By arranging the first speaker 1 and the second speaker 17 downwardly, the sound waves can be propagated to the surroundings 360 degrees around the electronic device by cooperating with the front chambers respectively. Thus, such arrangement can make the sound effect more uniform in all directions of the electronic device as compared with the traditional arrangement that the speakers are located on the side walls of the audio system. Therefore, the disclosed electronic device can have an omnidirectional uniform sound effect during the operation. Further, such arrangement can also facilitate the cooperation of the first speaker 1 and the second speaker 17 with other components of the electronic device.

As shown in FIGS. 2 and 4, the second chamber 3 can be surrounded by the input device 9 and the second chamber wall 11. In some embodiments, the input device 9 can form the top wall of the second chamber 3, and the second chamber wall 11 can form the side wall of the second chamber 3. The third chamber wall 12 can be located on the outer surface of the second chamber wall 11, and can have a convex shape.

The housing 8 can enclose the outside of the second chamber wall 11 and the third chamber wall 12, and can be tightly connected to the third chamber wall 12. The housing 8 can protect the second chamber wall 11 and the third chamber wall 12. A combination including the housing 8 at the outside, the input device 9 at the top, the second chamber wall 11 at the inside, and the third chamber wall 12 at the bottom can form the third chamber. The second chamber wall 11 can also serve as the side wall of the third chamber. The functional device assembly 4 can be located within the third chamber. The opening 7 can be located on bottom of the third chamber wall 12, as shown in FIG. 3.

In some embodiments, as shown in FIG. 3, the second chamber wall 11 can include an interconnection port 13 for interconnecting the outlet end 6 and the outside of the electronic device. The interconnection port 13 can be located at the bottom of the third chamber wall 12 and close to the opening 7, as shown in FIG. 3. As such, the air discharged from the hollow duct 5 can flow through the opening 7 to achieve air convection in the third chamber, thereby dissipating the heat generated by the functional device assembly.

In some alternative embodiments, the third chamber can have a closed structure with an opening 7, instead of forming by the second chamber wall 11, the housing 8 and the input device 9, etc.

In the above described structure, the opening 7 can be located on the bottom wall of the third chamber. Comparing providing the opening 7 on the side wall of the third chamber, the disclosed structure can further improve the heat dissipation effect, and does not affect the outlook appearance of the electronic device.

In the above described electronic device, in some embodiments, the first speaker 1 and the second speaker 17 can be arranged against each other. The first chamber 2 can be positioned between the first speaker 1 and the second speaker 17, and serving as a common front chamber of both of the first speaker 1 and the second speaker 17. As such, the structure of electronic device can be more compact, and the outlook appearance of the electronic device can be more beautiful and fashion.

In some embodiments, as shown in FIGS. 1, 2, 6, and 7, in order to ensure that the electronic device has a good audio effect for a long time, a casing 14 having a plurality of ventilation holes 15 can be provided to enclose the first chamber 2, the opening 7, the second speaker 17, and other components. The outer surface of the casing 14 can be wrapped with a dust barrier 16 to prevent the dust from entering the interior of the electronic device. As such, the sound waves can pass through the first chamber 2, the hollow hole 15, and the dust barrier 16, and the working life of the electronic device can be extended.

The provision of the examples described herein (as well as clauses phrased as "such as," "e.g.," "including," and the like) should not be interpreted as limiting the disclosure to the specific examples; rather, the examples are intended to illustrate only some of many possible aspects.

Although the present disclosure has been described and illustrated in the foregoing illustrative embodiments, it is understood that the present disclosure has been made only by way of example, and that numerous changes in the details of embodiment of the present disclosure can be made without departing from the spirit and scope of the present disclosure. Features of the disclosed embodiments can be combined and rearranged in various ways. Without departing from the spirit and scope of the present disclosure, modifications, equivalents, or improvements to the present disclosure are conceivable to those skilled in the art and are intended to be encompassed within the scope of the present disclosure.

What is claimed is:

1. An electronic device, comprising:

a first speaker for generating a first sound wave;

a second speaker for generating a second sound wave, the second speaker being located at a lower side of the first speaker and having a same orientation as the first speaker;

a first chamber located between the first speaker and the second speaker and coupled to the lower side of the first speaker for outputting the first sound wave generated by the first speaker;

a second chamber coupled to an upper side of the first speaker;

a functional device assembly in the second chamber including at least one functional device that generates heat during operation; and a hollow duct located in the second chamber for transporting air from the second chamber to an outlet of the hollow duct, dissipating heat generated by the functional device.

2. The electronic device of claim 1, wherein:

the first sound wave generated by the first speaker drives air from the second chamber into the hollow duct.

3. The electronic device of claim 1, wherein:

the air discharged from the outlet of the hollow duct passes by the functional device to dissipate heat from the functional device.

4. The electronic device of claim 1, wherein:

the first chamber is a front sound chamber of the first speaker; and the second chamber is a rear sound chamber of the first speaker.

5. The electronic device of claim 1, wherein:

the hollow duct is an inverting tube that changes a phase of the first sound wave generated by the first speaker.

6. The electronic device of claim 1, wherein:

the hollow duct changes the phase of the first sound wave in the second chamber to a same phase of the first sound wave in the first chamber to enhance an audio effect of the first speaker.

7. The electronic device of claim 1, wherein:

the outlet and an intake of the hollow duct are bent.

8. The electronic device of claim 7, wherein:

each of the intake and the outlet of the hollow duct is a divergent opening.

9. The electronic device of claim 8, wherein:

the intake of the hollow duct is obliquely extended with respect to a top wall of the second chamber.

10. The electronic device of claim 1, wherein:

a volume of the second chamber is larger than a volume of the first chamber.

11. The electronic device of claim 1, wherein:

the first sound wave has a frequency not higher than a first frequency threshold;

the second sound wave has a second frequency not higher than a second frequency threshold; and the second frequency threshold is higher than the first frequency threshold.

12. The electronic device of claim 1, further comprising:

a housing enclosing the second chamber and the functional device assembly.

13. The electronic device of claim 1, further comprising:

an input device located at an upper side of the second chamber.

14. The electronic device of claim 1, further comprising:

a casing having a plurality of ventilation holes for enclosing the first chamber and the second speaker;

wherein an outer surface of the casing is covered with a dust barrier.

15. An electronic device, comprising:

a first speaker for generating a first sound wave;

a first chamber coupled to a first side of the first speaker for outputting the first sound wave generated by the first speaker;

a second chamber coupled to a second side of the first speaker;

a functional device including at least one functional device that generates heat during operation;

a third chamber including at least one opening, the functional device being located in the third chamber; and a hollow duct located in the second chamber for transporting air from the second chamber to an outlet of the hollow duct to dissipate heat generated by the functional device;

wherein the air discharged from the outlet of the hollow duct passes through the at least one opening.

16. The electronic device of claim 15, wherein:

the air in the third chamber dissipates the heat of the functional device assembly by convection through the at least one opening.

17. The electronic device of claim 15, wherein:

the outlet of the hollow duct is obliquely extended with respect to a side wall of the second chamber towards a position of the at least one opening of the third chamber.

18. The electronic device of claim 15, wherein:

the at least one opening includes a first opening and a second opening, the air discharged from the outlet of the hollow duct enters the third chamber through the first opening; and the air flows out of the third chamber through the second opening, passing by the functional device.

* * * * *